US006957549B2

(12) United States Patent
Kim et al.

(10) Patent No.: US 6,957,549 B2
(45) Date of Patent: Oct. 25, 2005

(54) COOL AIR SUPPLYING APPARATUS OF REFRIGERATOR

(75) Inventors: Sang-Bae Kim, Gyeongsangnam-Do (KR); Sang-Ho Park, Gyeongsangnam-Do (KR); Byeong-Gyu Kang, Gyeongsangnam-Do (KR); Youn-Chul Choi, Busan (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/724,768

(22) Filed: Dec. 2, 2003

(65) Prior Publication Data

US 2004/0107724 A1 Jun. 10, 2004

(30) Foreign Application Priority Data

Dec. 6, 2002 (KR) ..... 10-2002-0077446

(51) Int. Cl.[7] ..... F25D 17/04; F25D 17/08

(52) U.S. Cl. ..... 62/408; 62/404; 62/405; 62/406; 62/407; 62/187

(58) Field of Search ..... 62/407–408, 187

(56) References Cited

U.S. PATENT DOCUMENTS

| | | | | |
|---|---|---|---|---|
| 4,282,720 | A * | 8/1981 | Stottmann et al. | 62/180 |
| 4,688,393 | A * | 8/1987 | Linstromberg et al. | 62/187 |
| 4,732,010 | A * | 3/1988 | Linstromberg et al. | 62/187 |
| 5,490,395 | A * | 2/1996 | Williams et al. | 62/187 |
| 5,884,496 | A * | 3/1999 | Kim et al. | 62/186 |
| 6,032,480 | A * | 3/2000 | Kim | 62/408 |
| 6,073,458 | A * | 6/2000 | Kim | 62/186 |
| 6,634,181 | B2 * | 10/2003 | Kim et al. | 62/407 |

* cited by examiner

*Primary Examiner*—Cheryl Tyler
*Assistant Examiner*—Filip Zec
(74) *Attorney, Agent, or Firm*—Fleshner & Kim LLP

(57) ABSTRACT

A cool air supplying apparatus of a refrigerator comprises a guide passage formed at a rear wall of a refrigerating chamber and provided with a plurality of discharge ports towards the refrigerating chamber for guiding cool air to a rear side of the refrigerating chamber, and a direction control unit installed at the guide passage for selectively opening and closing the discharge ports in order to control a discharge direction of cool air discharged into the refrigerating chamber.

25 Claims, 7 Drawing Sheets

COOL AIR SUPPLYING APPARATUS OF REFRIGERATOR

BACKGROUND OF THE INVENTION

1. Field of the Invention

The present invention relates to a cool air supplying apparatus of refrigerator, and more particularly, to a cool air supplying apparatus of refrigerator capable of fast and uniformly distributing temperature inside of a refrigerating chamber by controlling a discharge direction of cool air discharged into the refrigerating chamber according to temperature of each position inside of the refrigerating chamber.

2. Description of the Conventional Art

Generally, a refrigerator is divided into a freezing chamber for storing an icemaker and freezing items and a refrigerating chamber for receiving refrigerating items. The refrigerator is provided with a refrigerating cycle for performing a refrigerating cycle such as compression, condensation, expansion, and evaporation therein. By an operation of the refrigerating cycle, inside of the refrigerator is maintained as a freezing state or a cooling state.

FIG. 1 is a front view showing a refrigerator in accordance with the conventional art, and FIG. 2 is a lateral section view showing a refrigerator in accordance with the conventional art. As shown, the conventional refrigerator comprises: a freezing chamber 110 arranged at an upper portion of the refrigerator for storing freezing items; a refrigerating chamber 120 separated from the freezing chamber 110 by a compartment wall 116 for receiving refrigerating items; and a cool air supplying apparatus for supplying air cooled by a refrigerating cycle to the freezing chamber 110 and the refrigerating chamber 120.

The cool air supplying apparatus comprises: a blowing fan 113 mounted at a cooling chamber 102 positioned at an upper rear side of the freezing chamber 110 for forcibly blowing cool air cooled by an evaporator 103 of the refrigerating cycle; a supply duct 114 arranged at a front side of the blowing fan 113 and provided with a plurality of supply ports 115 towards the freezing chamber 110 for supplying cool air into the freezing chamber 110; an introduction passage 118 formed at the compartment wall 116 for introducing cool air circulating in the freezing chamber 110 into the cooling chamber 102; a guide passage 122 formed at a rear wall of the refrigerating chamber 120 and provided with a plurality of discharge ports 124 towards the refrigerating chamber 120 for guiding cool air introduced into the supply duct 114 to the rear side of the refrigerating chamber 120; and a circulation passage 126 formed at the compartment wall 116 for introducing cool air which has finished a cooling operation by circulating in the refrigerating chamber 120 into the cooling chamber 102.

Operation of the conventional refrigerator will be explained as follows.

First, the refrigerating cycle is driven and the blowing fan 113 is rotated. Then, cool air cooled by passing through the refrigerating cycle is discharged into the supply duct 114 by a blowing pressure of the blowing fan 113.

The cool air discharged into the supply duct 114 is respectively introduced into the supply ports 115 and the guide passage 122. The cool air introduced into the supply ports 115 circulates in the freezing chamber 110 thus to perform a cooling operation for freezing items stored in the freezing chamber 110, and then is introduced into the cooling chamber 102 via the introduction passage 118, thereby being cooled again.

Also, the cool air supplied to the guide passage 122 is introduced into the refrigerating chamber 120 via the discharge ports 124 and circulates in the refrigerating chamber 120, thereby performing a cooling operation for refrigerating items stored in the refrigerating chamber 120. Also, cool air which has finished the cooling operation of the refrigerating chamber 120 passes through the circulation passage 126 formed at the compartment wall 116 thus to be introduced into the cooling chamber 102 and cooled again.

However, in the conventional refrigerator, since cool air is introduced into the refrigerating chamber 120 via the discharge ports 124 of the air guide passage 122, temperature fluctuation becomes great according to a distance from the discharge ports 124 and thereby new load of high temperature is generated in the refrigerating chamber 120. According to this, it takes a lot of time to uniformly cool temperature inside of the refrigerating chamber 120.

Also, refrigerating items stored at a position adjacent to the discharge ports 124 is in directly contact with cool air of low temperature thus to be over-cooled, and refrigerating items stored at a position far from the discharge ports 124 is not relatively influenced by cool air thus not to be properly cooled.

Therefore, freshness of the refrigerating items stored in the refrigerating chamber 120 is not maintained and deterioration is generated.

SUMMARY OF THE INVENTION

Therefore, an object of the present invention is to provide a cool air supplying apparatus of a refrigerator capable of increasing freshness of a refrigerating chamber by fast and uniformly distributing temperature inside of a refrigerating chamber by controlling a discharge direction of cool air discharged into the refrigerating chamber according to temperature of each position inside of the refrigerating chamber.

To achieve these and other advantages and in accordance with the purpose of the present invention, as embodied and broadly described herein, there is provided a cool air supplying apparatus of a refrigerator comprising a guide passage formed at a rear wall of a refrigerating chamber and provided with a plurality of discharge ports towards the refrigerating chamber for guiding cool air to a rear side of the refrigerating chamber; and a direction control unit installed at the guide passage for selectively opening and closing the discharge ports in order to control a discharge direction of cool air discharged into the refrigerating chamber.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
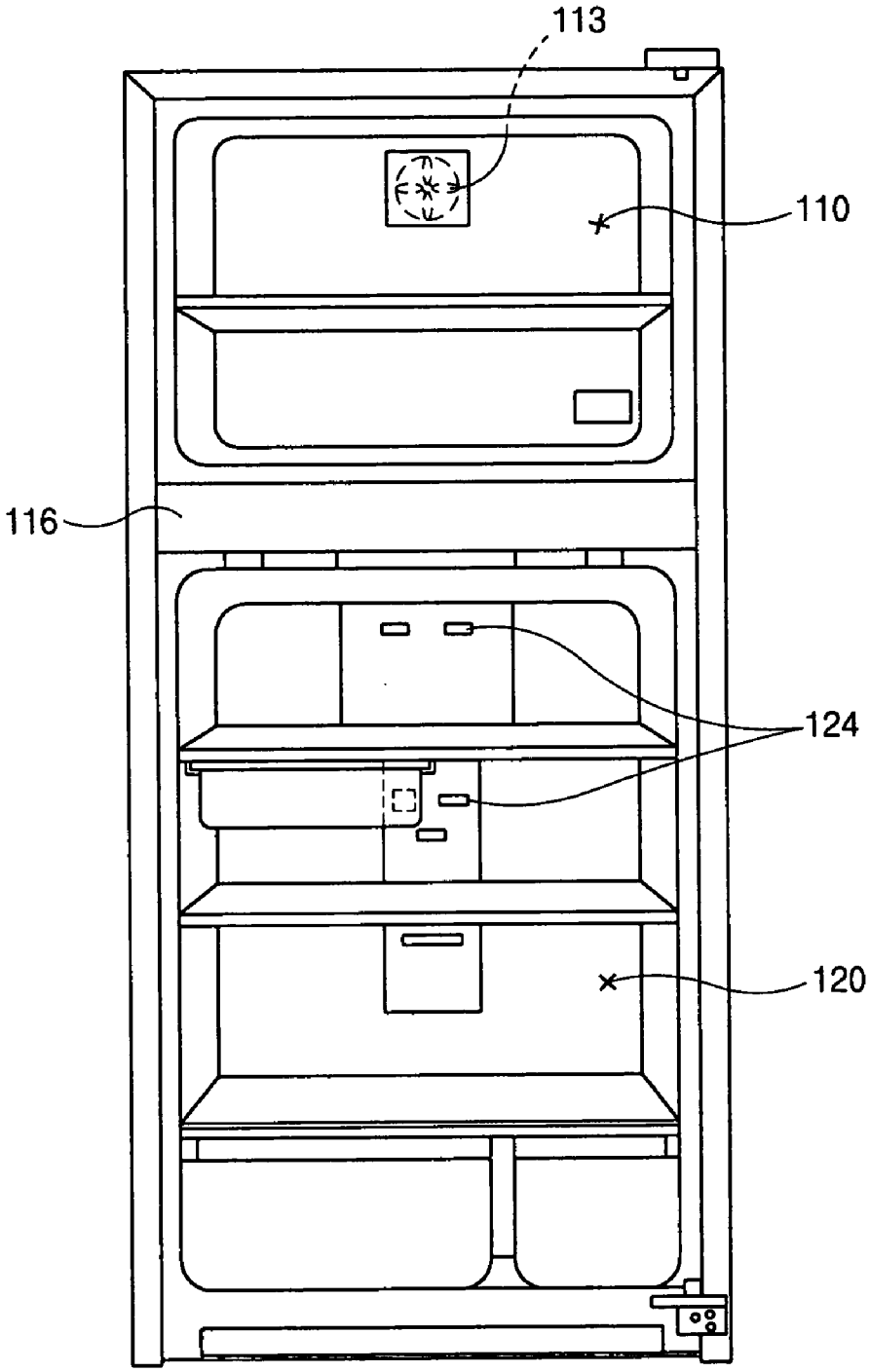
FIG. 1 CONVENTIONAL ART
FIG. 1 is a front view showing a refrigerator in accordance with the conventional art.
Figure 2:
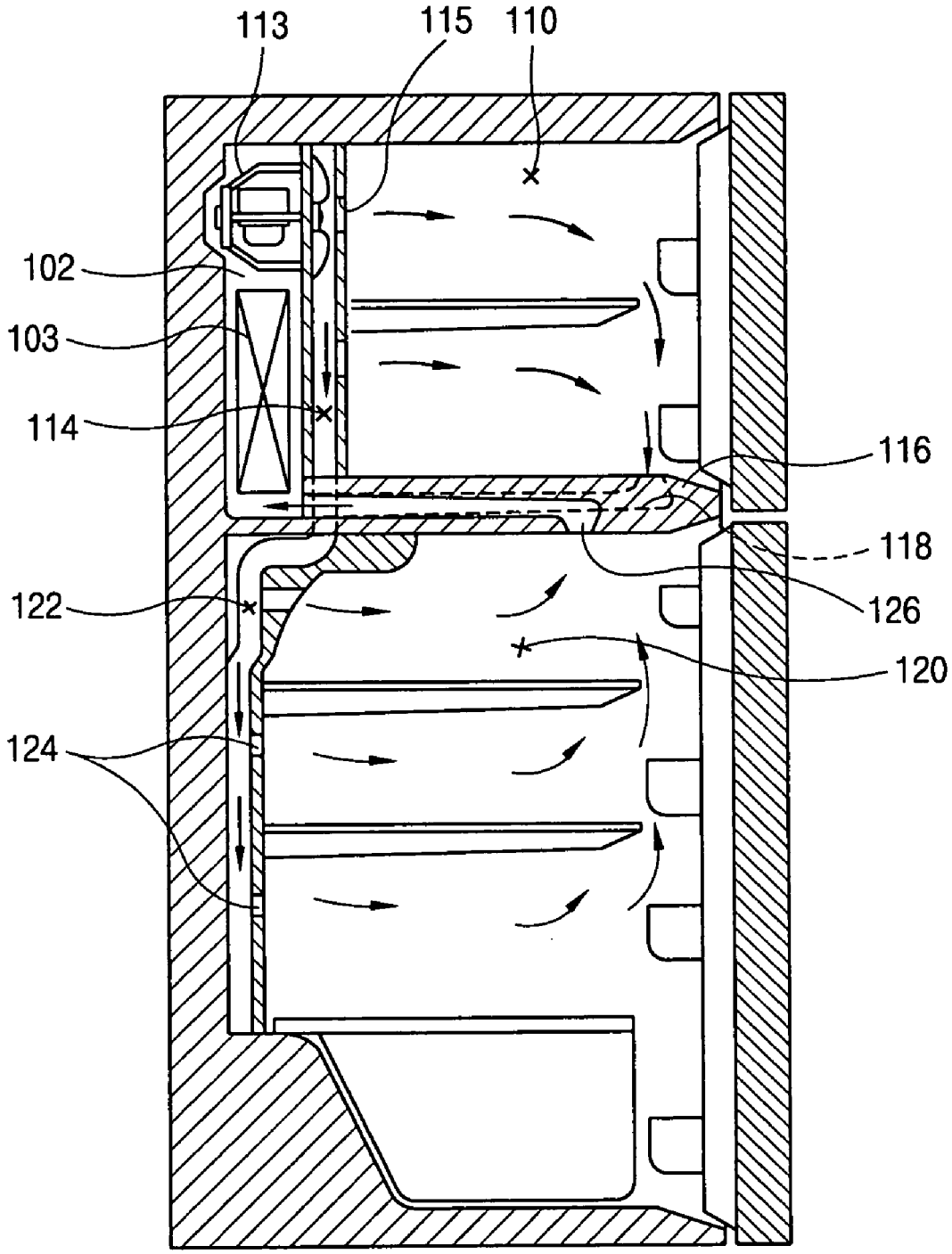
FIG. 2 CONVENTIONAL ART
FIG. 2 is a lateral section view showing a refrigerator in accordance with the conventional art.
Figure 3:
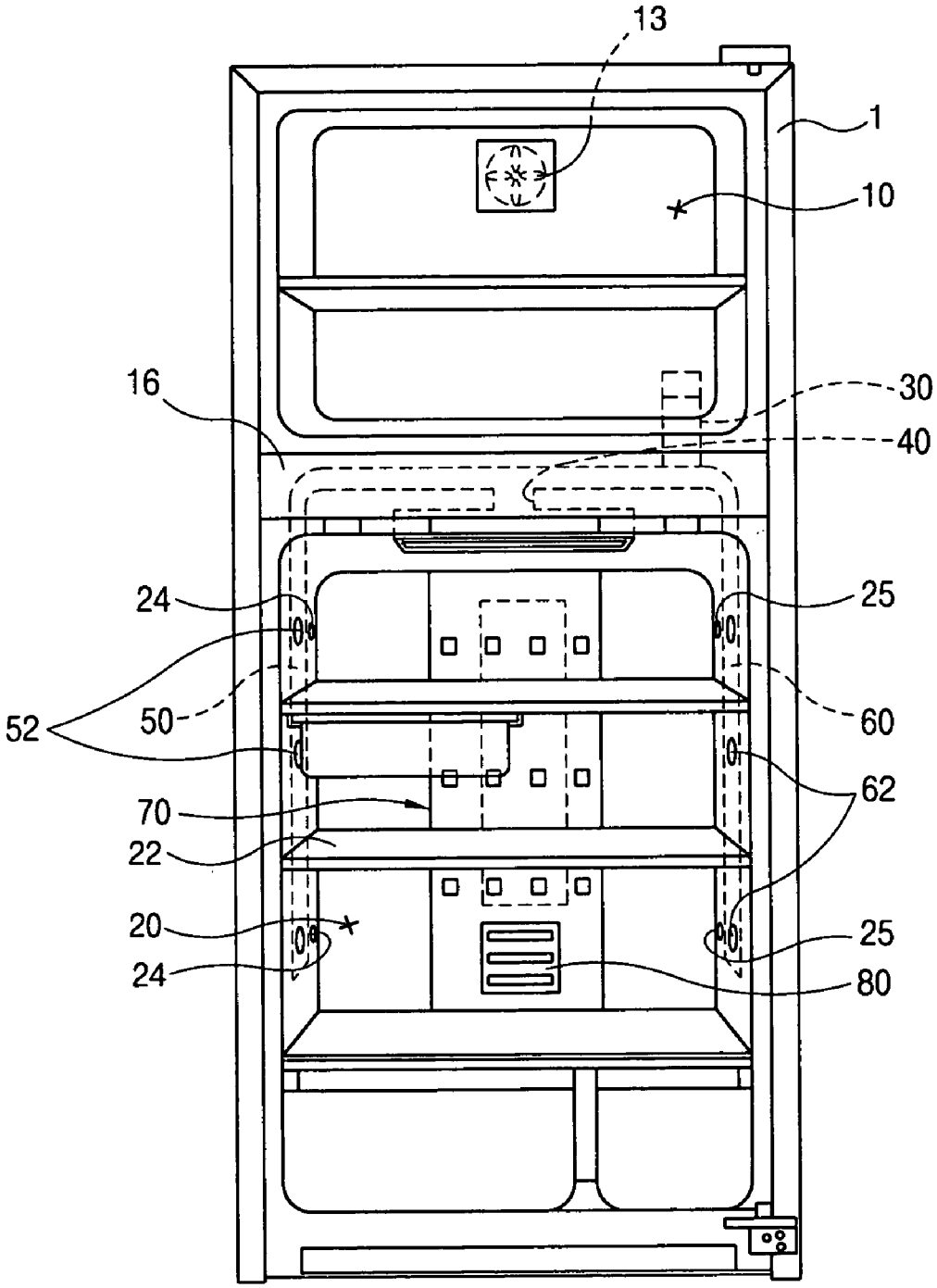
FIG. 3 is a front view showing a refrigerator provided with a cool air supplying apparatus according to the present invention.
Figure 4:
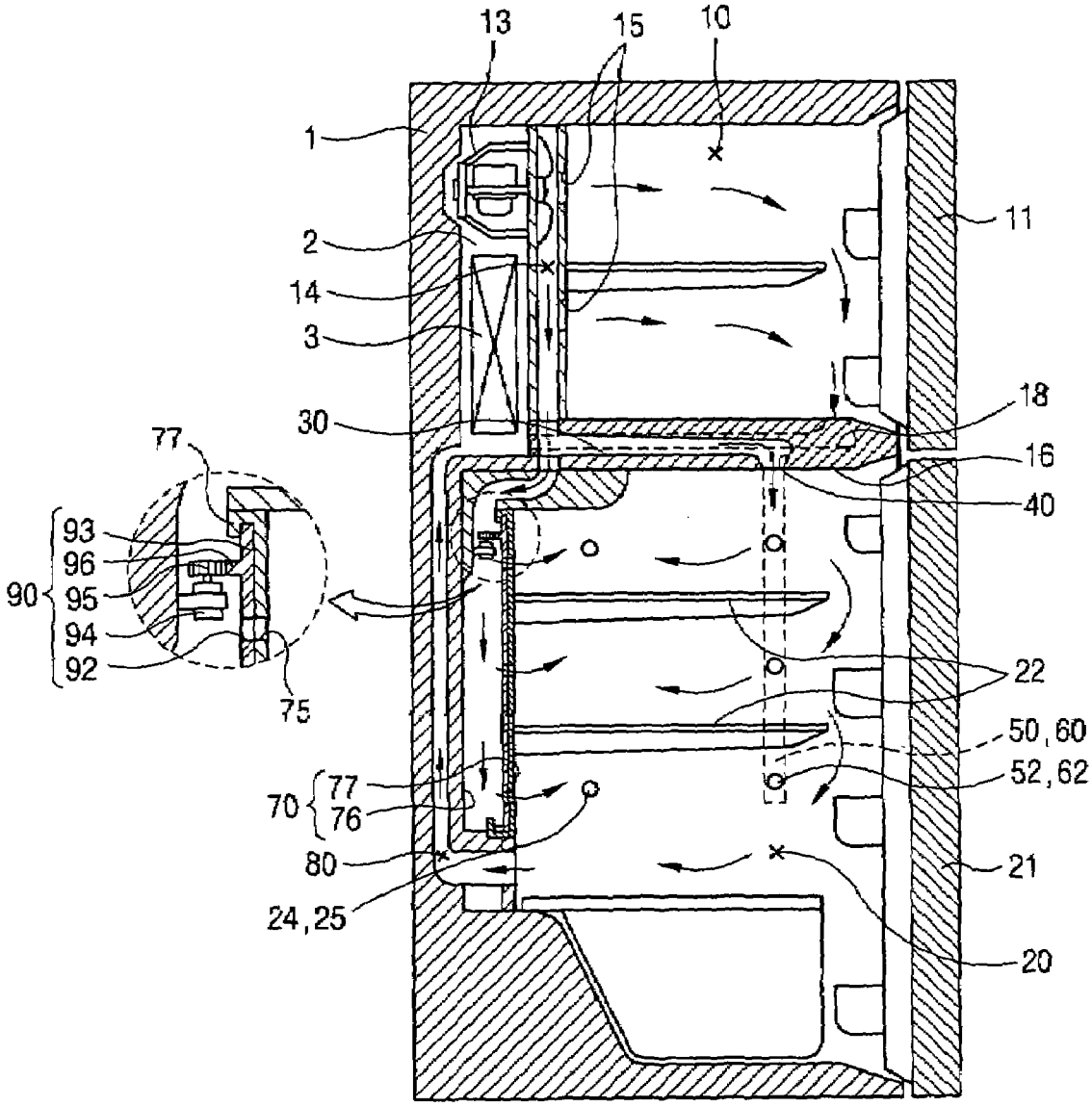
FIG. 4 is a lateral section view showing the refrigerator provided with a cool air supplying apparatus according to the present invention.

Reference will now be made in detail to the preferred embodiments of the present invention, examples of which are illustrated in the accompanying drawings.

As shown in FIGS. 3 to 6, a refrigerator provided with a cool air supplying apparatus according to the present invention comprises: a body 1 having a pair of doors 11 and 21 at a front side thereof and provided with a receiving space therein; a freezing chamber 10 arranged at an upper side of the body 1 for storing freezing items; a refrigerating chamber 20 separated from the freezing chamber 10 by a compartment wall 16 and provided with a plurality of shelves 22 for accommodating refrigerating items; and a cool air supplying apparatus for supplying cool air cooled by a refrigerating cycle to the freezing chamber 10 and the refrigerating chamber 20.

The cool air supplying apparatus comprises: a blowing fan 13 mounted at a cooling chamber 2 positioned at an upper rear side of the freezing chamber 10 for forcibly blowing cool air cooled by an evaporator 3 of the refrigerating cycle; a supply duct 14 arranged at a front side of the blowing fan 13 and provided with a plurality of supply ports 15 towards the freezing chamber 10 for supplying cool air into the freezing chamber 10; an introduction passage 18 formed at the compartment wall 16 for introducing cool air circulating in the freezing chamber 10 into the cooling chamber 2; a supply passage 30 formed in the compartment wall 16 and connected to the supply duct 14 for introducing cool air blown by the blowing fan 13 into the refrigerating chamber 20; a guide passage diverged from the supply passage 30 and composed of an upper guide passage 40 for guiding cool air to an upper side of the refrigerating chamber 20, left and right guide passages 50 and 60 for guiding cool air to left and right sides of the refrigerating chamber 20, and a rear guide passage 70 for guiding cool air to a rear side of the refrigerating chamber 20; a circulation passage 80 formed at the rear side of the refrigerating chamber 20 for introducing cool air which has finished a cooling operation by circulating in the refrigerating chamber 20 into the cooling chamber 2 from a lower side of the refrigerating chamber 20; a direction control unit 90 installed in the rear guide passage 70 for controlling a direction of cool air discharged from the rear guide passage 70 into the refrigerating chamber 20; temperature sensors 24 and 25 installed at left and right walls of the refrigerating chamber 20 for detecting temperature inside of the refrigerating chamber 20; and a control unit 100 for automatically controlling the direction control unit 90 according to temperature measured by the temperature sensors 24 and 25.

The left and right guide passages 50 and 60 are formed to be long at left and right walls of the refrigerating chamber 20 along an upper and lower direction and are provided with a plurality of supply ports 52 and 62 towards the refrigerating chamber 20 along the lengthwise direction for introducing cool air flowing along the left and right guide passages 50 and 60 into the refrigerating chamber 20.

The rear guide passage 70 includes a guiding groove 76 formed to be long and concave in the longitudinal direction at a middle portion of a rear wall of the refrigerating chamber 20, and a guiding plate 77 installed at a front side of the guiding groove 76, that is, at a side of the refrigerating chamber 20 and provided with a plurality of discharge ports 75 along the lengthwise and widthwise direction. The guiding groove 76 and the guiding plate 77 can be integrally formed. Herein, it is preferable that the guiding plate 77 is protruding towards the refrigerating chamber 20 so that cool air can be introduced into the refrigerating chamber 20 radially and a sectional surface of the guiding plate 77 has a circular arc shape.

Figure 5:
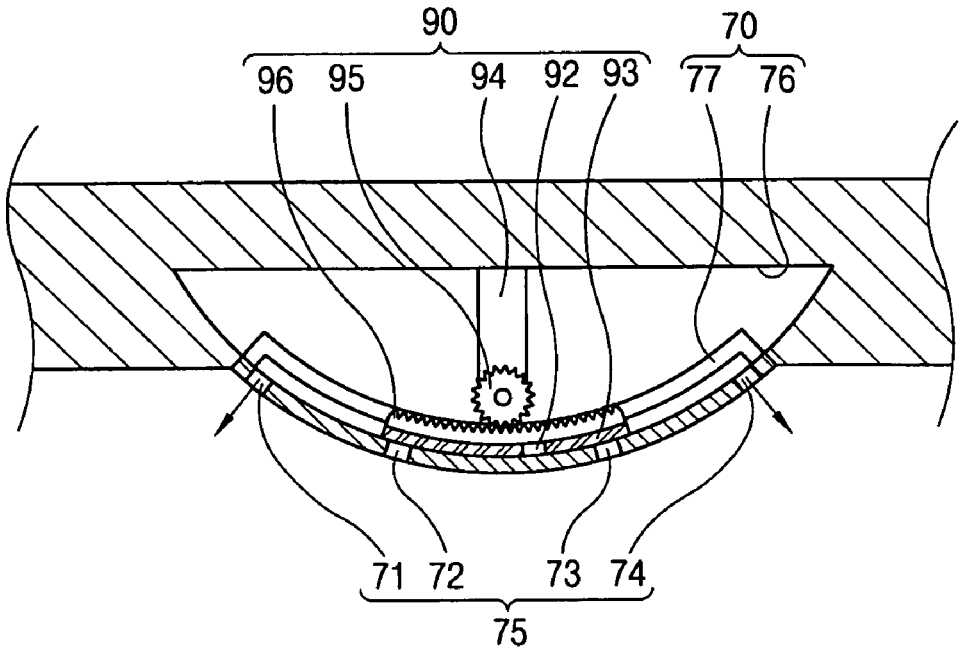
FIG. 5 is an expanded section view showing a direction control unit of the cool air supplying apparatus of the refrigerator according to the present invention.

A plurality of the discharge ports are also formed with a certain interval towards a widthwise direction of the guiding plate 77. That is, as shown in FIG. 5, a first discharge port 71, a second discharge port 72, a third discharge port 73, and a fourth discharge port 74 are respectively formed with a certain interval from the left side of the refrigerating chamber 20. Herein, the number and the interval of the discharge ports 75 are not limited to the embodiments of the present invention.

The direction control unit 90 is composed of a direction control plate 93 disposed near a rear side of the guiding plate 77 and provided with a connection hole 92 perforated at a position spaced from the center with a certain distance towards the widthwise direction, for selectively opening and closing the discharge ports 75 formed at the guiding plate 77 by moving towards the widthwise direction of the guiding plate 77; and a control plate driving unit for moving the direction control plate 93 towards the widthwise direction of the guiding plate 77.

It is preferable that the direction control plate 93 is slidably adhered to the rear side of the guiding plate 77, protruding towards the refrigerating chamber 20 like an inner curvature of the guiding plate 77, and has a sectional surface of a circular arc shape. Also, the connection hole 92 of the direction control plate 93 is formed to be connected to one of the discharge ports 75 by a movement of the direction control plate 93. A width of the direction control plate 93 and a position of the connection hole 92 are designed under a condition that all the plurality of discharge ports 75 are opened without being blocked by the direction control plate 93 when the connection hole 92 is connected to one of the discharge ports 75 by a movement of the direction control plate 93.

The control plate driving unit is composed of a driving motor 94 installed at the rear guide passage 70 for providing a driving force; a rack gear installed at a rear side of the direction control plate 93; and a pinion gear 95 installed at a motor shaft of the driving motor 94 and engaged to the rack gear 96 for converting a rotation force of the driving motor 94 into a right and left reciprocating motion of the rack gear 96. Herein, as the driving motor 94, a stepping motor rotated at a certain step angle is preferably used.

Figure 6:
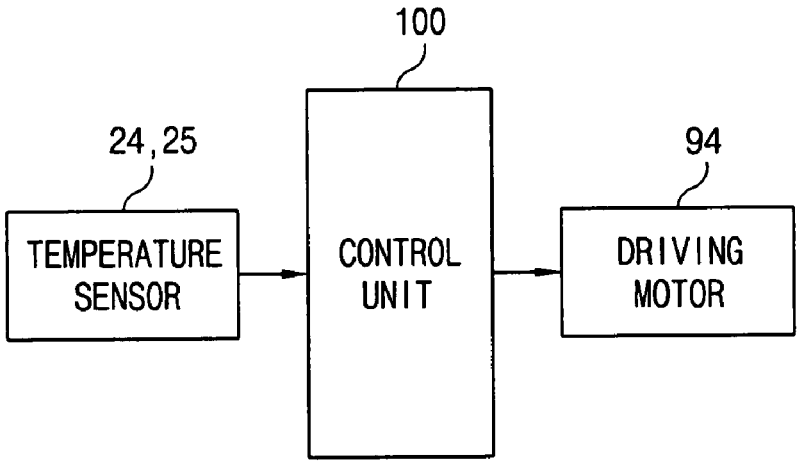
FIG. 6 is a block diagram for controlling the cool air supplying apparatus of the refrigerator according to the present invention.

As shown in FIG. 6, the control unit 100 controls an operation of the driving motor 94 of the direction control unit 90 according to a temperature detection result of the plurality of temperature sensors 24 and 25 arranged at right and left sides inside of the refrigerating chamber 20.

Hereinafter, operation of the cool air supplying apparatus of the refrigerator according to the present invention will be explained.

First, when a power source is supplied to the refrigerator, a compressor mounted in the refrigerator is driven thus to compress a gaseous refrigerant of low temperature and low pressure into a gaseous refrigerant of high temperature and high pressure. Then, the gaseous refrigerant of high temperature and high pressure passes through a condenser thus to be condensed into a liquid refrigerant of high temperature and high pressure. The condensed liquid refrigerant of high temperature and high pressure passes through an expansion valve thus to be converted into a liquid refrigerant of low temperature and low pressure. Then, the liquid refrigerant of low temperature and low pressure passes through the evaporator 3 thus to be converted into a gaseous refrigerant of low temperature and low pressure and evaporated. By the evaporation operation of the evaporator 3, peripheral air is heat-exchanged thus to be cooled.

Also, when the refrigerating cycle is operated and the blowing fan 13 is rotated, cool air cooled via the evaporator 3 of the refrigerating cycle installed at the cooling chamber 2 is discharged into the supply duct 14 by a blowing pressure of the blowing fan 13.

The cool air discharged into the supply duct 14 is respectively introduced into the supply ports 15 and the supply passage 30. The cool air introduced into the freezing chamber 10 via the supply ports 15 circulates in the freezing chamber 10 thus to perform a cooling operation for freezing items stored in the freezing chamber 10, and then is introduced into the cooling chamber 2 via the introduction passage 18, thereby being cooled again.

Also, the cool air supplied to the supply passage 30 flows by being diverged into the upper guide passage 40, the left guide passage 50, the right guide passage 60, and the rear guide passage 70.

Cool air which flows via the upper guide passage 40 is introduced into the refrigerating chamber 20 from the upper side of the refrigerating chamber 20, and cool air which flows via the left and right guide passages 50 and 60 pass through the supply ports 52 and 62 respectively formed at the left and right guide passages 50 and 60 thus to be introduced into the refrigerating chamber 20.

Also, cool air which flows via the rear guide passage 70 passes through the plurality of discharge ports 75 formed at the guiding plate 77 thus to be introduced into the refrigerating chamber 20 from the rear side of the refrigerating chamber 20.

The air introduced into the refrigerating chamber 20 via the upper guide passage 40, the left guide passage 50, the right guide passage 60, and the rear guide passage 70 circulates in the refrigerating chamber 20 thus to perform a cooling operation of stored refrigerating items. Also, cool air which has finished the cooling operation of the refrigerating chamber 20 is re-introduced into the cooling chamber 2 via the circulation passage 80 and re-cooled.

Meanwhile, at the time of an ordinary case that new load such as refrigerating items is not supplied into the refrigerating chamber 20 from outside of the refrigerating chamber 20, as shown in FIG. 5, the direction control plate 93 is positioned at a center of a widthwise direction of the guiding plate 77. Under this state, the second and third discharge ports 72 and 73 formed at the center of the guiding plate 77 are blocked by the direction control plate 93 thus to be closed, and the first and fourth discharge ports 71 and 74 respectively adjacent to left and right sides of the guiding plate 77 are not blocked by the direction control plate 93 thus to be opened.

Accordingly, cool air which flows via the rear guide passage 70 does not pass through the second and third discharge ports 72 and 73 but passes through the first and fourth discharge ports 71 and 74 thus to be introduced into the refrigerating chamber 20. Since the cool air introduced into the refrigerating chamber 20 via the rear guide passage 70 flows along left and right wall surfaces of the refrigerating chamber 20, refrigerating items stored at a position adjacent to the discharge ports 75 are not directly influenced by cool air thus to prevent a phenomenon that refrigerating items are over-cooled and to properly cool refrigerating items stored at a position relatively far from the discharge ports 75.

Figure 7:
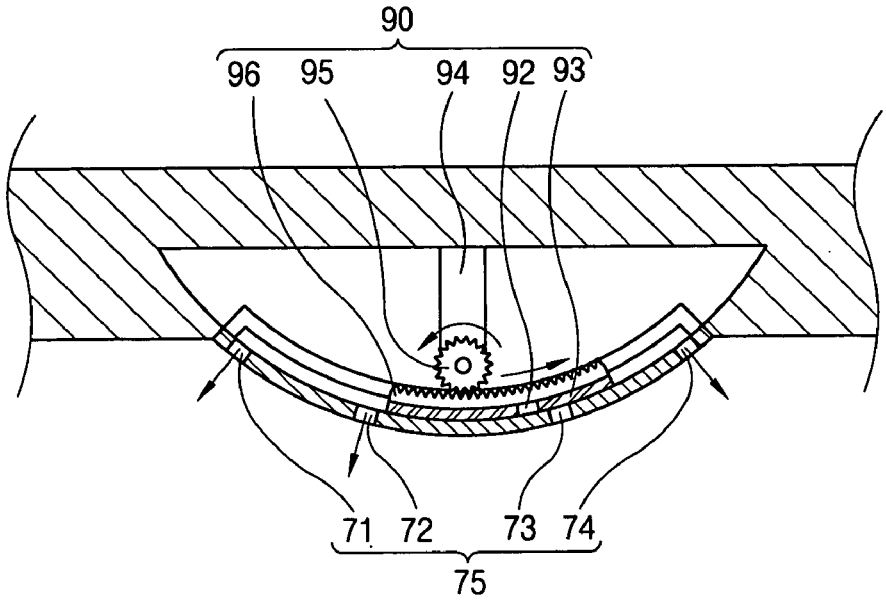
FIGS. 7 to 9 are operational state views of the direction control unit of the cool air supplying apparatus of the refrigerator according to the present invention.

Meantime, when temperature load is generated in accordance with new refrigerating items are stacked at the left side of the refrigerating chamber 20, the temperature sensors 24 and 25 installed at the left and right walls of the refrigerating chamber 20 detects temperature increase of the left side of the refrigerating chamber 20 and the detected signal by the temperature sensor 24 is transmitted to the control unit 100. Then, the control unit 100 operates the driving motor 94. According to this, as shown in FIG. 7, the pinion gear 95 installed at the motor shaft of the driving motor 94 is rotated counterclockwise and thereby the direction control plate 93 connected to the pinion gear 95 by the rack gear 96 moves towards the right direction. According to this, the first and fourth discharge ports 71 and 74 respectively formed at the left and right sides of the guiding plate 77 are opened, the third discharge port 73 is closed by the direction control plate 93, and the second discharge port 72 formed at the left side from the center of the guiding plate 77 is opened, thereby increasing an amount of cool air introduced into the left side of the refrigerating chamber 20. Therefore, a cooling operation for new load received at the left side of the refrigerating chamber 20 is fast performed.

Figure 8:
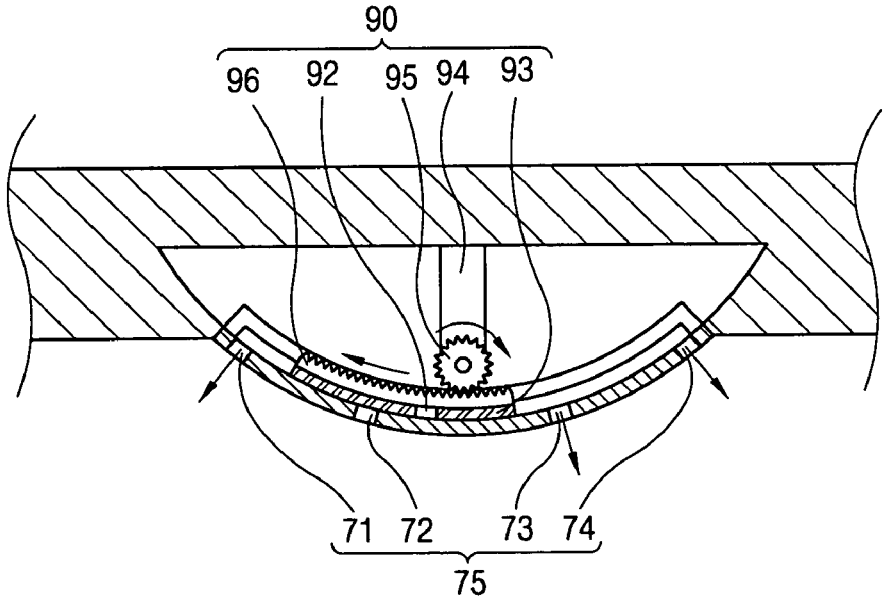

On the contrary, when temperature load is generated in accordance with new refrigerating items are stacked at the right side of the refrigerating chamber 20, the temperature sensors 24 and 25 installed at the left and right walls of the refrigerating chamber 20 detects temperature increase of the right side of the refrigerating chamber 20 and the detected signal by the temperature sensor 25 is transmitted to the control unit 100. Then, the control unit 100 operates the driving motor 94. According to this, as shown in FIG. 8, the pinion gear 95 installed at the motor shaft of the driving motor 94 is rotated clockwise and thereby the direction control plate 93 connected to the pinion gear 95 by the rack gear 96 moves towards the left direction. According to this, the first and fourth discharge ports 71 and 74 respectively formed at the left and right sides of the guiding plate 77 are opened, the second discharge port 72 is closed by the direction control plate 93, and the third discharge port 73 formed at the right side from the center of the guiding plate 77 is opened, thereby increasing an amount of cool air introduced into the right side of the refrigerating chamber 20. Therefore, a cooling operation for new load received at the right side of the refrigerating chamber 20 is fast performed.

Figure 9:
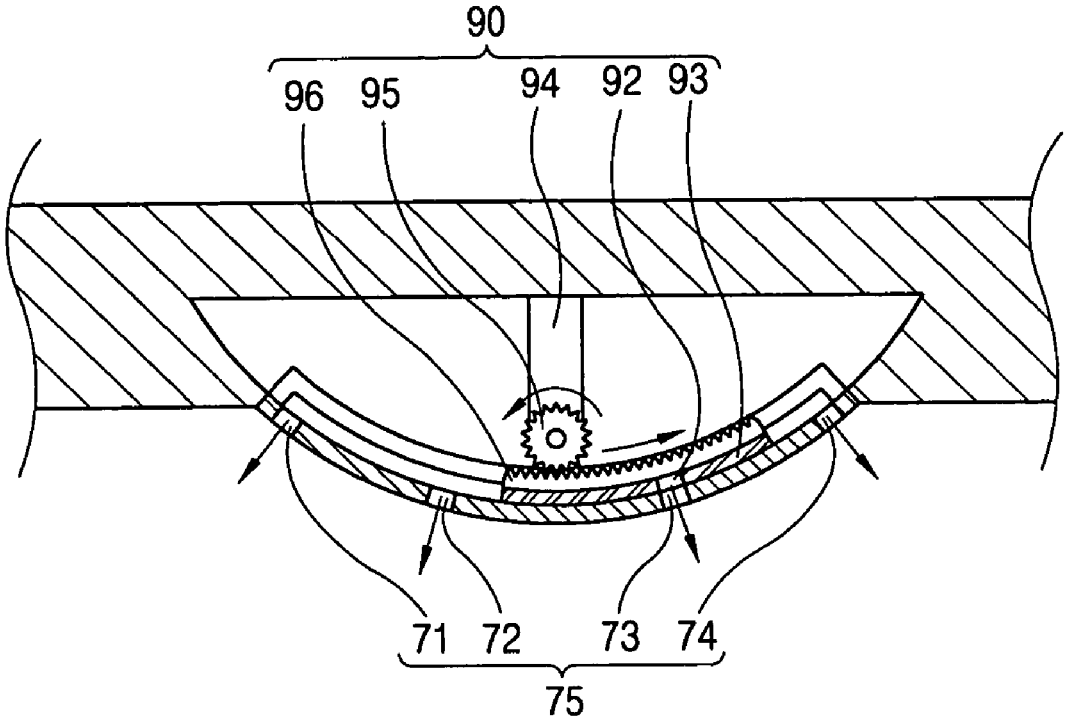

Also, when temperature load is simultaneously generated at the right/left sides and the center of the refrigerating chamber 20 or an amount of new load is great, the temperature sensors 24 and 25 installed at the left and right walls of the refrigerating chamber 20 detects temperature increase of the refrigerating chamber 20 and the detected signal by the temperature sensors 24 and 25 is transmitted to the control unit 100. Then, the control unit 100 operates the driving motor 94. According to this, as shown in FIG. 9, the motor shaft of the driving motor 94 and the pinion gear 95 are rotated clockwise so that the direction control plate 93 can be moved towards a direction that the connection hole 92 is formed. According to this, the direction control plate 93 connected to the pinion gear 95 by the rack gear 96 moves towards the right direction up to a position that the connection hole 92 and the third discharge port 73 are connected to each other. According to this, the first and fourth discharge ports 71 and 74 respectively formed at the left and right sides of the guiding plate 77 are opened and the second and third discharge ports 72 and 73 formed at the left and right sides of the center of the guiding plate 77 are all opened, thereby increasing an amount of cool air introduced into the left and right sides of the refrigerating chamber 20 and fast performing a cooling operation for new load received at the left and right sides of the refrigerating chamber 20.

Also, when a cooling operation for new load of the refrigerating chamber 20 is finished and thereby temperature inside of the refrigerating chamber 20 becomes uniform as usual, the control unit 100 operates the driving motor 94 according to a temperature detection result by the temperature sensors 24 and 25. According to this, as shown in FIG. 5, the direction control plate 93 is located at the original position of the widthwise direction center of the guiding plate 77. Under this state, the first and fourth discharge ports 71 and 74 positioned at the left and right sides of the guiding plate 77 are opened and the second and third discharge ports 72 and 73 adjacent to the center of the guiding plate 77 are closed. Therefore, cool air introduced into the refrigerating chamber 20 via the rear guide passage 70 flows along the left and right wall surfaces of the refrigerating chamber 20 and uniformly cools refrigerating items inside of the refrigerating chamber 20.

In the cool air supplying apparatus of the refrigerator according to the present invention, cool air introduced via the rear guide passage formed at the rear side of the refrigerating chamber flows along the left and right wall surfaces of the refrigerating chamber at ordinary times thus to reduce influence of refrigerating items adjacent to the discharge ports of the rear guide passage by the cool air, thereby preventing an over-cooling of the refrigerating items. Also, a left and right discharge direction of cool air is controlled by the direction control unit arranged at the rear guide passage, thereby fast performing a cooling operation of new load even if new load is generated at any side of the left and right sides of the refrigerating chamber. Furthermore, since all the discharge ports can be opened in a case by the direction control unit, new load is simultaneously generated at the left and right sides and the center of the refrigerator. According to this, even if temperature inside of the refrigerator is drastically increased, a cooling operation of the new load can be fast performed.

Besides, in the cool air supplying apparatus of the refrigerator according to the present invention, cool air is introduced not only from the rear side of the refrigerating chamber but also from the upper side and the left/right sides of the refrigerating chamber, thereby maintaining a cooling condition of refrigerating items stored in the refrigerating chamber at an optimum state and increasing refrigerating efficiency.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cool air supplying apparatus of a refrigerator, comprising:

a guide passage formed at a rear wall of a refrigerating chamber and provided with a plurality of discharge ports towards the refrigerating chamber for guiding cool air to a rear side of the refrigerating chamber, wherein the plurality of discharge ports are formed at a distance from each other in a widthwise direction of the guide passage;

temperature sensors installed at each position of the refrigerating chamber, for detecting temperature inside the refrigerating chamber;

a direction control plate disposed near a surface of the guide passage where the discharge ports are formed and moving along a widthwise direction of the guide passage, for selectively opening and closing a selection of the discharge ports to control a direction of cool air discharged into the refrigerating chamber;

a control plate driving unit for moving the direction control plate; and a control unit for automatically controlling the control plate driving unit according to temperature inside the refrigerating chamber detected by the temperature sensors.

2. The apparatus of claim 1, wherein the control plate driving unit comprises:

a driving motor for providing a driving force;

a rack gear installed at one side of the direction control plate; and a pinion gear installed at a motor shaft of the driving motor and engaged to the rack gear, for transmitting a driving force of the driving motor to the rack gear.

3. The apparatus of claim 2, wherein the driving motor is a stepping motor rotated at a certain step angle.

4. The apparatus of claim 1, wherein the selected discharge ports positioned at a side corresponding to a direction that the direction control plate is moved are closed and the selected discharge ports positioned at an opposite side to a direction that the direction control plate is moved are opened when the direction control plate is moved to one side from a widthwise direction center of the guide passage.

5. The apparatus of claim 1, wherein the direction control plate is provided with a connection hole perforated at a position spaced from a center of the direction control plate with a certain distance, and the connection hole is connected to one discharge port by a movement of the direction control plate.

6. The apparatus of claim 5, wherein all the discharge ports are opened when the connection hole is connected to one of the discharge ports.

7. The apparatus of claim 1, wherein the guide passage comprises:

a guiding groove formed to be long in a longitudinal direction at a rear wall of the refrigerating chamber; and a guiding plate installed at a front side of the guiding groove and provided with a plurality of discharge ports along lengthwise and widthwise directions thereof.

8. The apparatus of claim 7, wherein the guiding plate and the direction control plate are protruding towards the refrigerating chamber and have a sectional surface of a circular arc shape.

9. The apparatus of claim 1, further comprising:

left and right guide passages formed at left and right walls of the refrigerating chamber and provided with a plurality of supply ports towards the refrigerating chamber along a lengthwise direction thereof, for guiding cool air to left and right sides of the refrigerating chamber; and an upper guide passage formed at an upper side of the refrigerating chamber for guiding cool air to the upper side of the refrigerating chamber.

10. A cool air supplying apparatus of a refrigerator, comprising a guide passage formed at a rear wall of a refrigerating chamber and provided with a plurality of discharge ports towards the refrigerating chamber for guiding cool air to a rear side of the refrigerating chamber, wherein the plurality of discharge ports are formed at a distance from each other in a widthwise direction of the guide passage;

a direction control unit installed at the guide passage for selectively opening and closing a selection of the discharge ports in order to control a discharge direction of cool air discharged into the refrigerating chamber;

temperature sensors installed at each position of the refrigerating chamber for detecting a position where high temperature load is generated in the refrigerating chamber; and a control unit for automatically controlling the direction control unit in order to set a discharge direction of cool air to be towards the position where high temperature load is generated according to a temperature signal detected by the temperature sensors.

11. The apparatus of claim 10, wherein the direction control unit comprises:

a direction control plate disposed near a surface where the discharge ports are formed and moving along a widthwise direction of the guide passage, for selectively opening and closing the selected discharge ports; and a control plate driving unit for moving the direction control plate.

12. The apparatus of claim 11, wherein the direction control plate is provided with a connection hole perforated at a position spaced from a center of the direction control plate with a certain distance, and the connection hole is connected to one discharge port by a movement of the direction control plate.

13. The apparatus of claim 12, wherein all the discharge ports are opened when the connection hole is connected to one discharge port.

14. The apparatus of claim 11, wherein the control plate driving unit comprises:

a driving motor for providing a driving force;

a rack gear installed at one side of the direction control plate; and a pinion gear installed at a motor shaft of the driving motor and engaged to the rack gear, for transmitting a driving force generated from the driving motor to the rack gear.

15. The apparatus of claim 14, wherein the driving motor is a stepping motor rotated at a certain step angle.

16. The apparatus of claim 10, wherein the guide passage is protruding towards the refrigerating chamber and has a sectional surface of a circular arc shape.

17. The apparatus of claim 10, further comprising:

left and right guide passages formed at left and right walls of the refrigerating chamber and provided with a plurality of supply ports towards the refrigerating chamber along a lengthwise direction thereof, for guiding cool air to left and right sides of the refrigerating chamber; and an upper guide passage formed at an upper side of the refrigerating chamber for guiding cool air to the upper side of the refrigerating chamber.

18. A cool air supplying apparatus of a refrigerator, comprising:

a guide passage formed at a rear wall of the refrigerating chamber and provided with a plurality of discharge ports configured to guide cool air to a rear side of the refrigerating chamber, wherein the plurality of discharge ports are formed at a distance from each other in a widthwise direction of the guide passage; and a direction control plate configured to selectively open and close a selection of the discharge ports to selectively direct cool air to different portions of the refrigerating chamber.

19. The cool air supplying apparatus of a refrigerator of claim 18, further comprising:

a plurality of temperature sensors that generate temperature signals; and a controller configured to receive the temperature signals and to control the direction control plate, based on the temperature signals, so as to direct cool air to the warmest portions of the refrigerating chamber.

20. The direction control plate of claim 19, wherein the direction control plate has at least one connection hole which can be aligned with a discharge port of the guide passage.

21. The cool air supplying apparatus of claim 1, wherein the guide passage extends in a longitudinal direction, said guide passage having a plurality of discharge ports formed at a distance from each other, in a widthwise direction of the guide passage, and wherein the direction control plate controls a discharging direction of cool air by selectively opening and closing the selected discharge ports.

22. The apparatus of claim 21, wherein a width of the direction control plate is smaller than a distance between two discharge ports respectively positioned near both ends of the guide passage in a widthwise direction of the guide passage.

23. The apparatus of claim 21, wherein at least one discharge port is maintained in an opened state.

24. The apparatus of claim 21, wherein groups of the discharge ports are formed at a distance from each other in a longitudinal direction of the guide passage.

25. The cool air supplying apparatus of claim 10, wherein the guide passage extends in a longitudinal direction, said guide passage having a plurality of discharge ports formed at a distance from each other in a widthwise direction of the guide passage, and wherein the direction control unit controls a discharging direction of cool air by selectively opening and closing the selected discharge ports.

* * * * *